United States Patent [19]

Barnstorf

[11] 4,333,687

[45] Jun. 8, 1982

[54] HOLDER FOR THE ATTACHMENT OF CUTTERS TO MINING AND TUNNELLING MACHINES

[75] Inventor: Ingo Barnstorf, Frankfurt, Fed. Rep. of Germany

[73] Assignee: Kennametal Inc., Latrobe, Pa.

[21] Appl. No.: 177,070

[22] Filed: Aug. 11, 1980

[30] Foreign Application Priority Data

Dec. 15, 1978 [DE] Fed. Rep. of Germany ..... 2854307

[51] Int. Cl.[3] ..... E21C 35/22

[52] U.S. Cl. ..... 299/81; 299/17; 299/86; 173/58

[58] Field of Search ..... 299/1, 12, 81, 17, 86; 173/58; 175/25, 67, 243

[56] References Cited

FOREIGN PATENT DOCUMENTS

| | | | |
|---|---|---|---|
| 10534 | 4/1980 | European Pat. Off. | 299/81 |
| 619642 | 8/1978 | U.S.S.R. | 299/81 |
| 621873 | 8/1978 | U.S.S.R. | 299/81 |
| 685821 | 9/1979 | U.S.S.R. | 299/86 |

*Primary Examiner*—Ernest R. Purser

*Attorney, Agent, or Firm*—Lawrence R. Burns

[57] ABSTRACT

Disclosed is a holder for the attachment of cutters or bits, to mining and tunnelling machines, which has at least one spray nozzle for coolant spraying of the cutter working area. The holder comprises means for receiving the cutter shank in the holder, an insert sleeve surrounding the cutter shank inserted with axial play in the means for receiving the cutter shank and a shut-off member carried on the insert. The shut-off member engages into a coolant supply line to the spray nozzle when a pressure load is applied to the cutter and shuts off the coolant supply when there is no load on the cutter.

13 Claims, 10 Drawing Figures

HOLDER FOR THE ATTACHMENT OF CUTTERS TO MINING AND TUNNELLING MACHINES

BACKGROUND OF THE INVENTION

In the use of mining and tunnelling machines equipped with cutters or bits in underground mining sparking occurs, particularly when working in harder formations, where the cutter contacts the formation. Under unfavorable conditions, these sparks can lead to the ignition of explosive gas mixtures. Such sparking in the working area is exceedingly undesirable, particularly in coal mining. Efforts are, therefore, made to eliminate the sparking in the working area of the cutter as far as possible by supplying a coolant such as water.

Attempts have already been made to eliminate the sparking in the working area of the cutters by spraying the cutting head with water. Since the engagement area of the cutters on the formation to be extracted is not cooled directly, this method has not yet proved particularly successful.

It has further been proposed to spray water or another coolant behind each individual cutter tip and thus to directly cool the cutter working area. Admittedly, this suppresses sparking very effectively but results in a large accumulation of coolant which is extremely undesirable in underground working.

To reduce the high water accumulation in the case of individual spraying of the cutters, it has already also been proposed to provide the coolant passages to the spray nozzles with shut-off means which are in controllable dependence upon the application of a pressure load to the cutter in such a manner that the coolant spraying of the cutter working areas takes place only during the actual working engagement with the formation, whereas during the cutter idling the coolant spraying is cut off. However, this holder has a relatively complicated and expensive structure with which, for example, on disturbance of the coolant supply, it is very difficult or impossible to replace individual parts.

The problem underlying the invention is to provide a cutter holder of the type mentioned at the beginning whose spraying means, which switches off when the cutter is idling, is reliable and the parts of which mainly prone to trouble and wear can easily be replaced without having to replace the entire holder.

BRIEF SUMMARY OF THE INVENTION

This problem is solved according to the invention substantially in that into the cutter receiving means of the holder an insert surrounding the cutter shank is inserted with axial play, said insert carrying a shut-off member which engages into the coolant supply line of the spray nozzle and which frees the coolant supply to the spray nozzle when there is an application of a pressure load on the cutter and shuts off said supply when there is no application of load on the cutter.

With this construction of the cutter, the wear which is inevitable due to the rough operating conditions when using mining extraction and tunnelling machines underground occurs mainly at the insert surrounding the cutter shank so that to obviate wear damage which is detrimental to the work of the cutter, in most cases only the insert need be replaced. This also applies to a wear of the shut-off member in the coolant supply line, by which the coolant spraying of the cutter cutting path is in controlled dependence upon the application of a pressure load.

An advantageous embodiment of the cutter is obtained if the shut-off member surrounds the insert sleeve annularly and lies between two axially displaced annular passages which are formed by the insert sleeve and the holder receiving means and one of which communicates with a coolant supply passage coming from the machine and the other of which communicates with a coolant supply passage terminating in the spray nozzle. In this embodiment, the shut-off member has on the one hand a robust construction while on the other hand the insert sleeve can be turned in the holder body without impairing the control of the coolant flow to the spray nozzle. To enable inaccuracies in the shut-off region to be easily compensated and to avoid impairing the blocking function of the shut-off member, it is also expedient for the latter to be provided with a conical shut-off surface which cooperates with an annular shoulder, preferably provided with a seal in the holding receiving means.

Furthermore, for this purpose, the shut-off member can bear with its outer periphery on the inner wall of the holder receiving means and can be provided with edge recesses whose depth is less than the depth of the annular shoulder cooperating with the shut-off member so that they permit passage of the coolant only when the shut-off surface of the shut-off member is raised from the associated annular shoulder.

A convenient sealing of the coolant supply region disposed within the holder receiving means in the axial direction is possible by the arrangement of annular cord seals which also execute the movement of the insert sleeve.

For shutting off the coolant supply to the spray nozzle when the cutter is idling, it is advisable to bias the insert sleeve by pressure springs supported on the holder body in the direction of an axially front end position closing the coolant flow path. The pressure springs are expediently mounted in receiving bores of the front end face of the holder body, engaging below a front region of the insert sleeve. This ensures on the one hand that they cannot become detached and on the other that they are easy to assemble and disassemble after removal of the insert sleeve.

A particularly advantageous construction of the insert sleeve is obtained when the latter is made up of two sleeve sections supplementing each other in the axial direction, the free ends of which are provided in each case with a stop collar limiting the axial mobility of the entire sleeve. This makes it possible to insert the two sleeve sections from opposite sides into the receiving means of the holder body and then connect them together, whereafter they are secured in the holder body with an axial play which can be fixed by the adjustment of their connection.

The shut-off member is preferably formed at the axially inner end of the rear sleeve section. The two sleeve sections may be conveniently connected together by screwing. The rear sleeve section is advantageously being provided with outerend lateral flattened portions for application of an assembly tool.

The insert sleeve may comprise, at its front collar, flattened portions, and the holder body may have at least one stop web on which at least one of the collar flattened portions bears. With this construction, the insert sleeve is nonrotatable after insertion into the holder body but is axially movable. It is, however, alternatively possible to arrange the insert sleeve rotatably in the receiving means of the holder body in order to improve or support the rotatability of the cutter in this manner.

The exact nature of the present invention will become more clearly apparent upon reference to the following detailed specification taken in connection with the accompanying drawings in which:

DETAILED DESCRIPTION OF THE INVENTION

Figure 2:
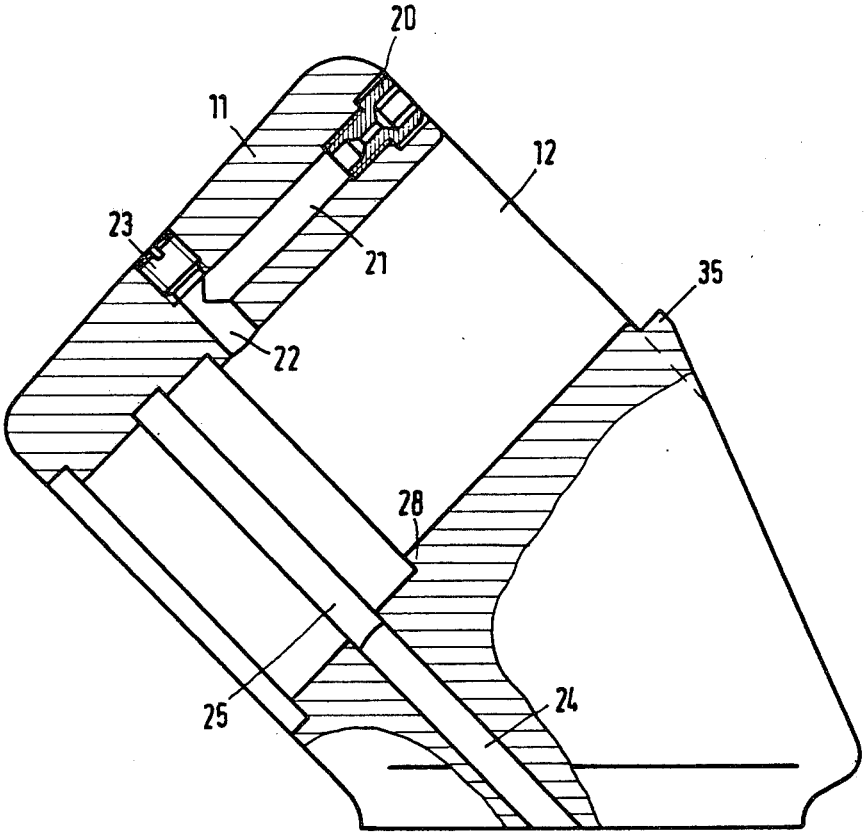
FIG. 2 shows the holder body without cutter and without insert sleeve in longitudinal section.

The cutter holder according to the invention includes a holder body, or support block, 11 which is secured to a cutting head, a cutter roller, a continuous chain or the like of a mining extraction and tunnelling or driving machine. Said holder body comprises a through receiving means or socket 12 (FIG. 2) for a working cutter 13. The cutter 13 is inserted in the embodiments illustrated with a circular shank 14 into the receiving means 12.

Figure 3:
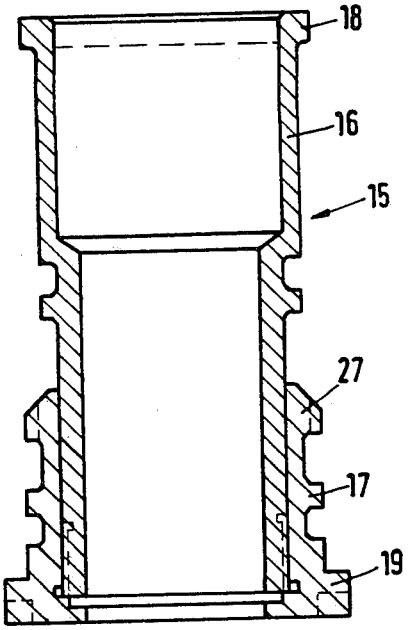
FIG. 3 is a longitudinal section of the insert sleeve.

Between the shank 14 of the cutter 13 and the inner wall of the receiving means 12, an insert sleeve 15 is inserted which, as is more clearly apparent from FIG. 3, consists of two sleeve sections 16 and 17 which are, preferably, joined together by a screw connection. The insert sleeve 15 is provided at its two ends with a collar 18 and 19, respectively, which, in cooperation with the opposing edges of the receiving means 12, form stops which limit the axial movement of the insert sleeve 15. The spacing of the stops 18, 19 is selected from respect to the length of the receiving means 12 in such a manner that a limited axial displaceability of the insert sleeve 15 remains.

In the holder body 11 there is disposed behind the cutter 13, seen in the working direction, a spray nozzle 20 at the end of a passage 21 extending substantially parallel to the cutter receiving means 12. A coolant, preferably water, is sprayed by this nozzle 20 into the bit cutting path of suppress sparking on engagement of the cutter tips on the formation to be extracted. For supplying the coolant to the nozzle 20, the passage 21 adjoins a transverse passage 22 which, at one end, terminates in the cutter receiving means 12 of the holder body 11 and at the other end is sealed from the outside of the holder by a closure plug 23, being accessible, if necessary, by removing said plug. A further passage 24 in the holder body 11 connected to a coolant supply line opens out opposite the transverse passage 22 offset with respect thereto in the axial direction of the cutter receiving means 12.

To transfer the coolant from the supply passage 24, an annular passage 25 immediately adjoining the supply passage 24 is formed between the inner wall of the receiving means 12 of the holder body 11 and the lower portion 17 of the insert sleeve 15. At the level of the opening of the transverse passage 22 into the receiving means 12, there is a further passage 26 formed between the inner wall of the receiving means 12 and the upper portion 16 of the insert sleeve 15.

Figure 1:
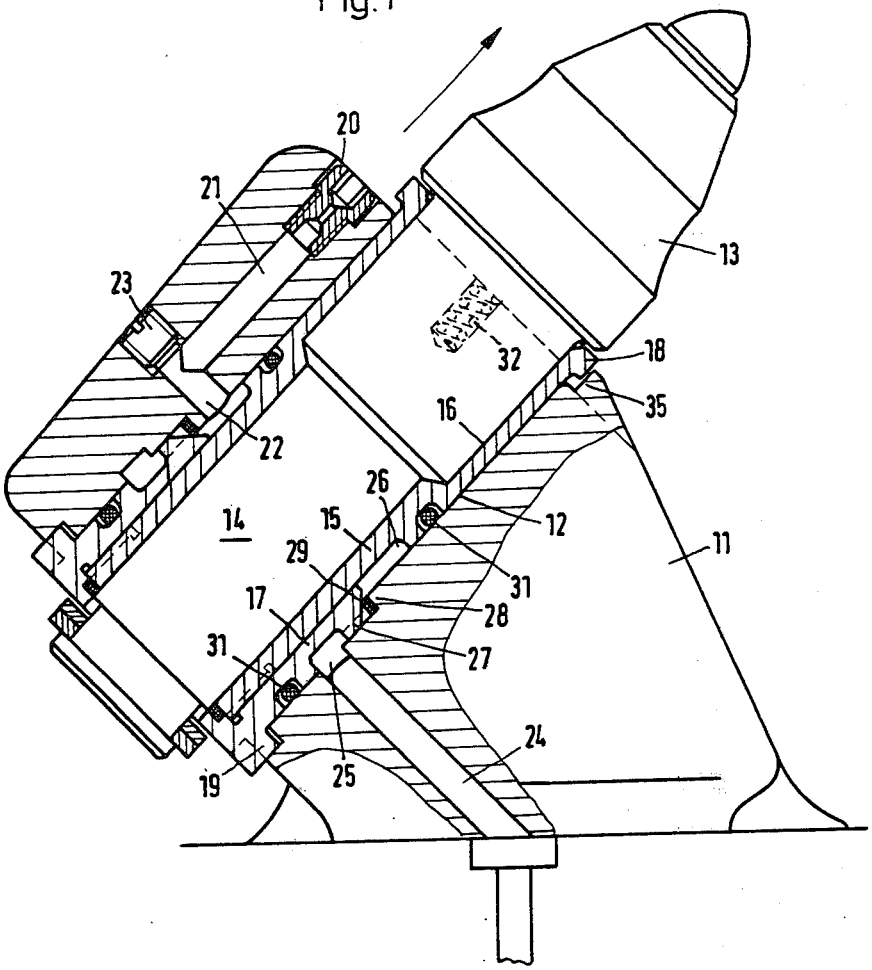
FIG. 1 is a longitudinal section of a cutter holder according to the invention which is attached to the cutting head of an extraction and tunnelling machine and into which a circular shank cutter or bit is inserted.

Between the annular passage 25 and the passage 26 is a sealing cone 27 which forms the shut-off member and which is formed at the inner end of the portion 17 of the insert sleeve 15. The sealing cone 27 lies with a conical shut-off surface opposite an annular shoulder 28 of the inner wall of the receiving means 12 of the holder body 11 on which a seal ring 29 bears. The sealing cone bears in the rest position illustrated in FIG. 1 of the cutter 13 and the insert sleeve 15 on the seal 29 and thus interrupts the communication between the annular passage 25 and the passage 26 between the insert sleeve and the wall of the receiving means. In this position, the flow of a coolant from the supply passage 24 to the spray nozzle 20 is prevented.

Figure 4:
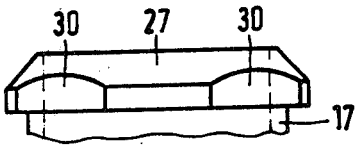
FIG. 4 is a partial view of the shut-off member of the insert sleeve.
Figure 5:
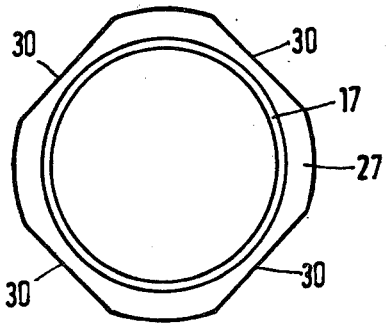
FIG. 5 is a plan view of the cut-off member of the insert sleeve.

As apparent in particular from FIGS. 4 and 5, the sealing cone 27 comprises flute-like edge recesses 30 which are distributed over the periphery and through which a coolant flow is possible from the annular passage 25 to the passage 26 and, thus, to the spray nozzle 20 as soon as the sealing cone is lifted off the seal 29 at the annular shoulder 28. This happens when there is a pressure load on the cutter 13 when the latter engages a formation to be extracted, by which it is displaced together with the insert sleeve 15 up to the stop of the collar 18 at the upper edge of the receiving means axially into the holder body.

On axial displacement of the insert sleeve, the sealing cone 27, which is mounted on the lower sleeve section 17, is also lifted from the annular shoulder 28 or the engaging sealing ring 29. For reliable sealing of the coolant flow path in the region of the sealing means 12, circular cord rings 31 are inserted into the insert sleeve 15 on both sides of the passages 25 and 26 and can also execute the axial movement of the sleeve without their sealing ability being impaired.

Figure 7:
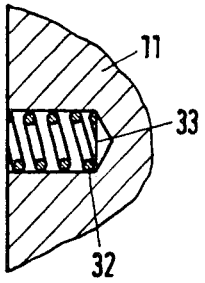
FIG. 7 is a section along line C-D of FIG. 6.
Figure 6:
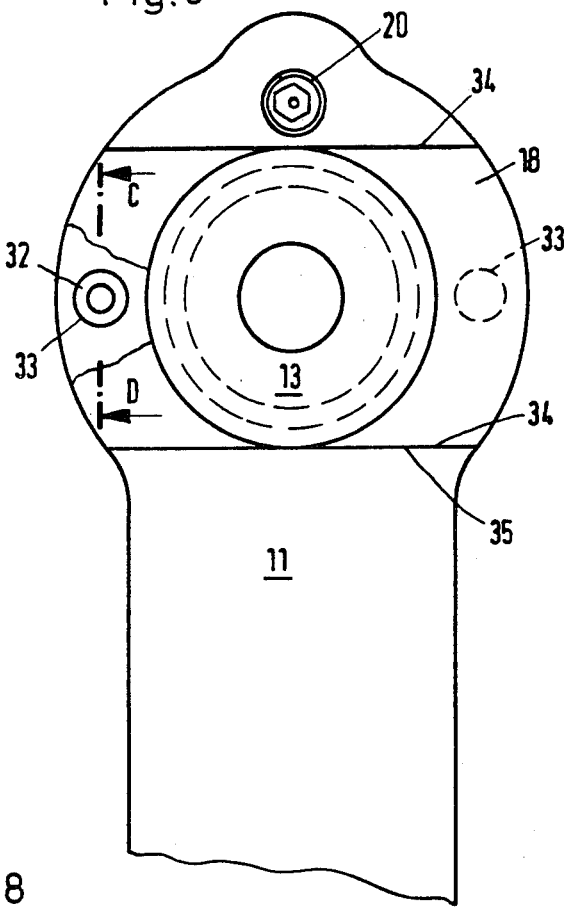
FIG. 6 is a plan view of the cutter holder according to the invention with an inserted circular shank cutter.

As illustrated in FIGS. 6 and 7, to ensure that the cutter 13 together with the insert sleeve 15 is disposed in the unloaded, i.e., idling, condition in a position in which the coolant flow to the spray nozzle is interrupted by the sealing cone 27, pressure springs 32 are accommodated in bores 33 in the upper end wall, said springs bearing on the lower side of the collar 18 of the insert sleeve 15 and displacing the latter in the application direction of the cutter until the sealing cone 27 bears tightly on the seal 29 of the annular shoulder 28. On axial loading of the cutter during engagement with a formation to be extracted, the cutter and sleeve are then pushed back against the action of these springs 32 into a position which raises the sealing cone 27 from the seal 29 of the annular shoulder 28.

For completeness, it should be added that, as apparent from FIG. 6, in the first embodiment of the cutter holder according to the invention, the collar 18 of the front sleeve section 16 of the insert sleeve 15 is flattened at two opposite sides. One of these flattened sides 34 bears against an associated web 35 of the holder body 11 so that, in this manner, a rotation of the insert sleeve 15 in the holder body 11 is prevented.

Figure 9:
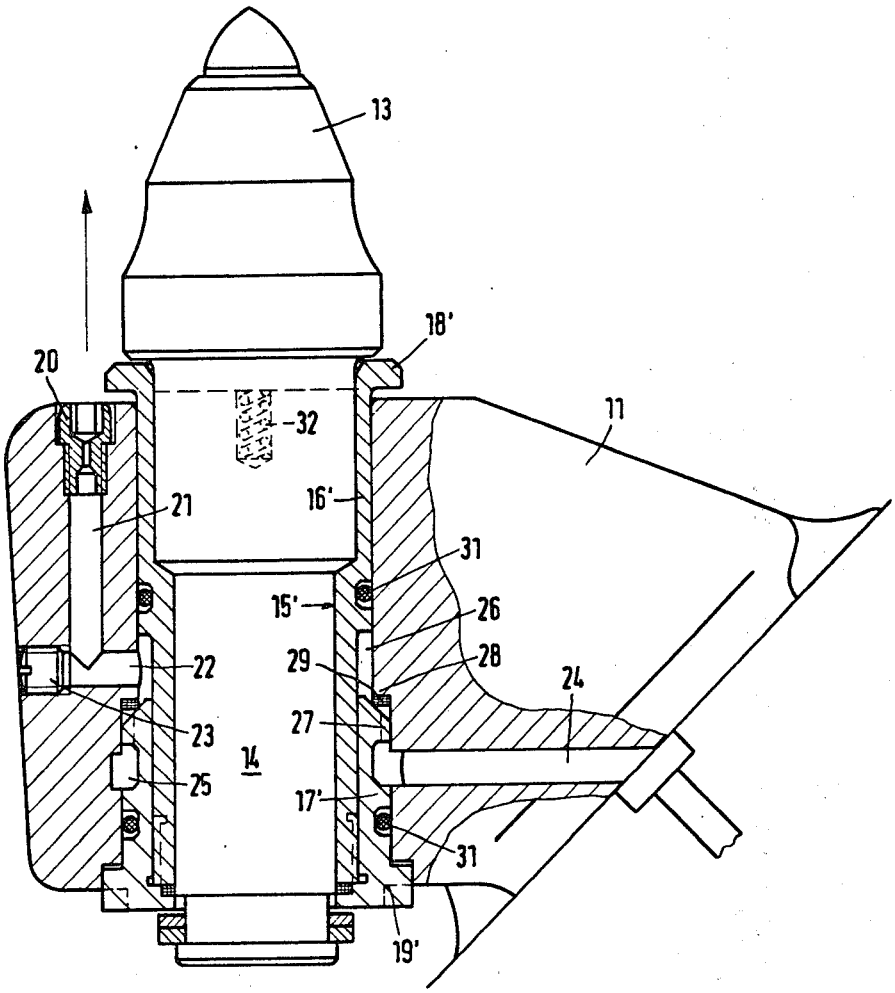
FIG. 9 shows a further embodiment of the holder according to the invention in longitudinal section with inserted circular shank cutter.
Figure 10:
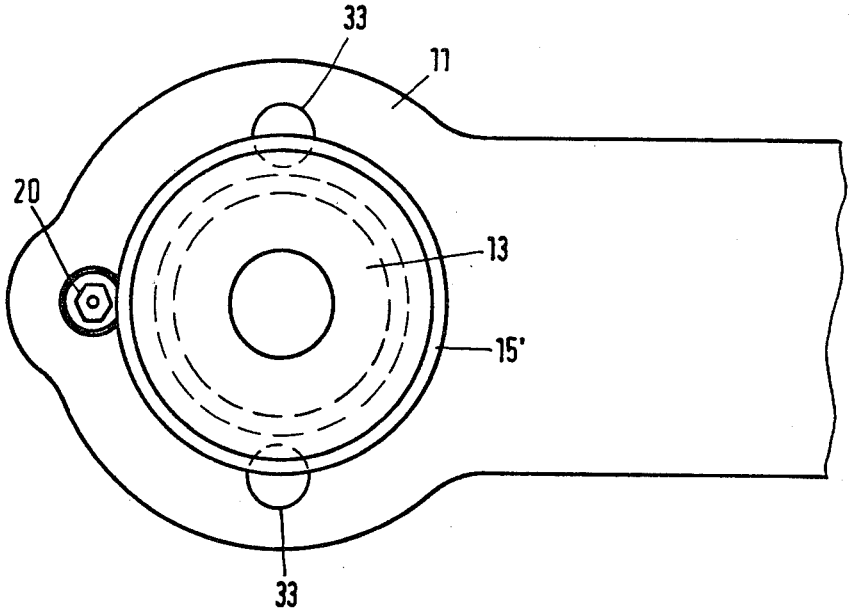
FIG. 10 is a plan view of the embodiment illustrated in FIG. 9.

In the embodiment illustrated in FIGS. 9 and 10, however, the collar 18' of the front sleeve 16' of the insert sleeve 15' is made cylindrical and the web 35 on the holder body 11 omitted. The sleeve 15' is thus rotatable in the holder body 11, thereby additionally supporting the rotatability of the cutter 13.

Figure 8:
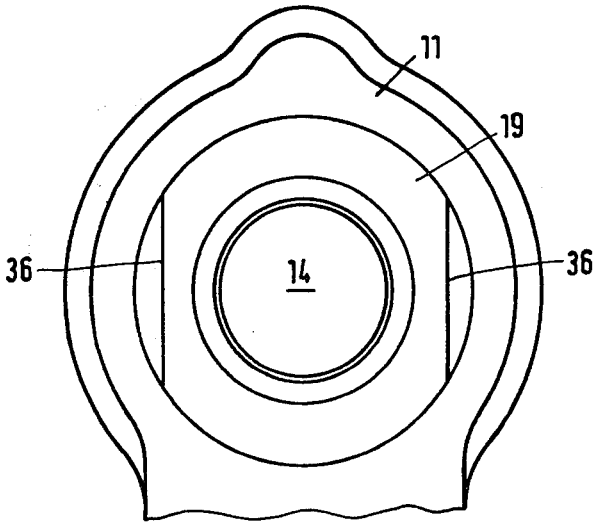
FIG. 8 is a bottom view of the cutter holder according to the invention with inserted circular shank cutter.

It is further apparent from FIG. 8 that the rear sleeve section 17 of the insert sleeve 15 also comprises, at its outer end, two flattened portions 36 which are intended for application of an assembly tool, such as a spanner, to release or tighten the connection between the two sleeve sections 16 and 17. In this manner, a new sleeve combination can rapidly and easily be fitted when the insert sleeve 15 is completely or partially worn.

Modifications may be made within the scope of the appended claims.

What is claimed is:

1. A holder for the attachment of cutters, in particular, circular shank cutters, to mining and tunnelling machines, which has at least one spray nozzle for coolant spraying of the bit working area, the coolant supply for which is in controlled dependence upon an application of a pressure load to the cutter, comprising: means for receiving said cutter shank in said holder; an insert sleeve surrounding said cutter shank inserted with axial play in said means for receiving said cutter shank; a shut-off member, carried on said insert, which engages into a coolant supply line to said spray nozzle when a pressure load is applied to said cutter and shuts off said coolant supply when there is no load on said cutter.

2. A holder according to claim 1 wherein said shut-off member surrounds the insert sleeve annularly and lies between two axially displaced annular passages which are formed by said insert sleeve and said means for receiving a cutting shank and one of which communicates with a coolant supply passage of said coolant supply line coming from said machine and the other of which communicates with a coolant supply passage of said coolant supply line terminating in said spray nozzle.

3. A holder according to claims 1 or 2 wherein said shut-off member comprises a conical shut-off surface which surrounds said insert sleeve and which cooperates with an annular shoulder having a seal in said means for receiving said cutter shank.

4. A holder according to claim 3 wherein said shut-off member having an outer periphery which bears on an inner wall of said holder means for receiving said cutter shank and is provided with an edge recess whose depth is less than the depth of said annular shoulder cooperating with said shut-off member.

5. A holder according to claim 4 wherein portions of said coolant passages open toward said holder means for receiving said cutter shank and extend substantially radially to the center axis of said receiving means.

6. A holder according to claim 2 wherein said two axially displaced annular passages form a coolant carrying section lying within said holder receiving means which is sealed in the axial direction on both sides by annular cord seals which also execute the movement of said insert sleeve.

7. A holder according to claim 1 further comprising pressure springs in said holder and wherein said insert sleeve is biased by said pressure springs in the direction of an axially front end position closing said coolant supply line.

8. A holder according to claim 7 wherein said pressure springs are mounted in receiving bores in a front end face of said holder and engage with and under a front region of said insert sleeve.

9. A holder according to claim 1 wherein said insert sleeve comprises two sleeve sections, a rear and a front section, which supplement each other in the axial direction, the free ends of which are provided in each case with a stop collar limiting the axial mobility of said insert sleeve.

10. A holder according to claim 9 wherein said shut-off member is formed at the axially inward end of said rear sleeve section.

11. A holder according to claims 9 or 10 wherein said two sleeve sections are screwed together and said rear sleeve section has outer-end lateral flattened portions for application of a turning tool.

12. A holder according to claim 11 wherein said insert sleeve comprises, at the front, stop collar flattened portions and said holder body comprises at least one stop web on which at least one of said front stop collar flattened portions bears.

13. A holder according to claim 1 wherein said insert sleeve is rotatably mounted in said means for receiving said cutter shank.

* * * * *